US005776034A

United States Patent [19]

Stamler

[11] Patent Number: 5,776,034

[45] Date of Patent: Jul. 7, 1998

[54] WRIST AND FOREARM EXERCISE DEVICE

[75] Inventor: Lenny Stamler, Calgary, Canada

[73] Assignee: Pro 4 Arm Ltd., Calgary, Canada

[21] Appl. No.: 850,113

[22] Filed: May 1, 1997

[51] Int. Cl.[6] ..... A63B 23/14

[52] U.S. Cl. ..... 482/46; 482/45

[58] Field of Search ..... 482/45, 46, 44, 482/114, 115

[56] References Cited

U.S. PATENT DOCUMENTS

| | | | |
|---|---|---|---|
| 3,717,338 | 2/1973 | Hughes . | |
| 3,830,493 | 8/1974 | Miller | 482/46 |
| 4,095,789 | 6/1978 | Mueller . | |
| 4,171,802 | 10/1979 | Stoecker . | |
| 4,203,591 | 5/1980 | Gibson . | |
| 4,487,709 | 12/1984 | Kobayashi et al. . | |
| 4,643,417 | 2/1987 | Nieman | 482/46 |
| 4,838,542 | 6/1989 | Wilkinson . | |
| 5,425,690 | 6/1995 | Chang . | |
| 5,507,377 | 4/1996 | Lindsay et al. . | |

*Primary Examiner*—Lynne A. Reichard
*Attorney, Agent, or Firm*—Oyen Wiggs Green & Mutala

[57] ABSTRACT

A wrist exerciser has a pair of coaxially mounted hand grip bodies. The hand grip bodies can be counter-rotated against a resistance to exercise the muscles in a user's forearms. A friction disk is sandwiched between the two hand grip bodies with a friction surface on one of the bodies bearing against the friction disk. The two hand grip bodies are biased toward each other to clamp the friction disk. The amount of bias force can be varied to set the amount of resistance to the rotation of the hand grip bodies relative to each other. The exerciser includes a spring connected to a member which is slidably mounted in a bore within one of the hand grip bodies. The member is prevented from rotating in the bore. The position of the member can be adjusted by turning an adjustment knob which is threadedly engaged with a threaded rod extending from the member. The bearing is located at one end of the spring. A thrust bearing between the adjustment knob and the hand grip body makes the adjustment knob easy to turn. The bias mechanism of the invention allows the resistance to rotation of the two hand grip bodies to be easily and accurately set. The adjustment of the biasing mechanism is not susceptible to being changed as the device is used. The invention may be used to provide an adjustable drag in other types of exercise equipment and other applications where an adjustable drag is desirable.

20 Claims, 4 Drawing Sheets

WRIST AND FOREARM EXERCISE DEVICE

TECHNICAL FIELD

This invention relates to an exercise device of the type which includes left and right coaxially aligned hand grip bodies which can be counter-rotated against a resistance force to develop muscle strength in a user's wrist and forearms. In particular, the invention relates to a wrist and forearm exercise device in which the resistance force is variable.

BACKGROUND

People in all walks of life can benefit from increasing the strength in their wrists and forearms. There are various pieces of exercise equipment that may be used to develop strength in the wrists and forearms. Such equipment includes weights suspended from ropes; compression exercisers which comprise springs or other resilient materials that can be squeezed in a user's hand; and small bar bells. Much of this equipment is not easily portable.

There are hand and wrist exercisers of the general type which include a pair of hand grips which are mounted generally coaxially to each other and which can be rotated relative to each other against a resistance force. Such devices can be made to be lightweight and portable. A user can use such devices develop his or her forearm muscles by counter-rotating the hand grips against the resistance force. Users of such devices can also benefit by loosening and stretching the muscles and tendons of their wrists. A device of this general type is described in U.S. Pat. No. 4,171,802.

A problem with some such wrist exercisers is that the degree of resistance offered to rotation of the hand grips is fixed and cannot be adjusted. Consequently, a wrist exerciser which may be suitable for use by one individual may provide resistance forces too large for some individuals. The exerciser may offer too little resistance to provide sufficient exercise to other individuals. Some other exercise devices of this general type allow the resistance force to be adjusted. However, often the adjustments are not particularly precise or repeatable, the resistance setting can tend to change as the hand grips on the device are rotated while a user exercises. Finally, many such previous devices do not provide accurate, repeatable calibration of the resistance provided by the device.

Some prior art devices in this general field are described in the U.S. Pat. Nos. to: Gibson, 4,203,591; Stoecker, 4,171,802; Mueller 4,095,789; Miller, 3,830,493; Holten, 5,569,136; Bertka et al., 5,487,709; Francu, 4,913,417; Odonnell et al., 4,852,873; and, Wilkinson, 4,838,542.

SUMMARY OF THE INVENTION

A first aspect of the invention provides an exercise device which overcomes some of the foregoing disadvantages. Accordingly the invention provides an exercise device comprising: a first hand grip body; and a second hand grip body mounted coaxially to the first hand grip body for rotation relative to the first hand grip body about an axis. Biasing means are provided for biasing the first hand grip body toward the second hand grip body. The biasing means comprises: an adjustment member slidably but non-rotationally mounted in a bore of the second hand grip body, adjustment means for adjusting the position of the adjustment member along the bore, and, a spring extending between the adjustment member and a force transmission member extending from the first hand grip body. Preferably the spring is a compression spring and the adjustment member comprises a housing which receives the compression spring.

BRIEF DESCRIPTION OF THE DRAWINGS

Drawings which illustrate preferred embodiments of the invention but which should not be construed so as to limit the scope of the invention are appended in which.

DETAILED DESCRIPTION

Figure 1:
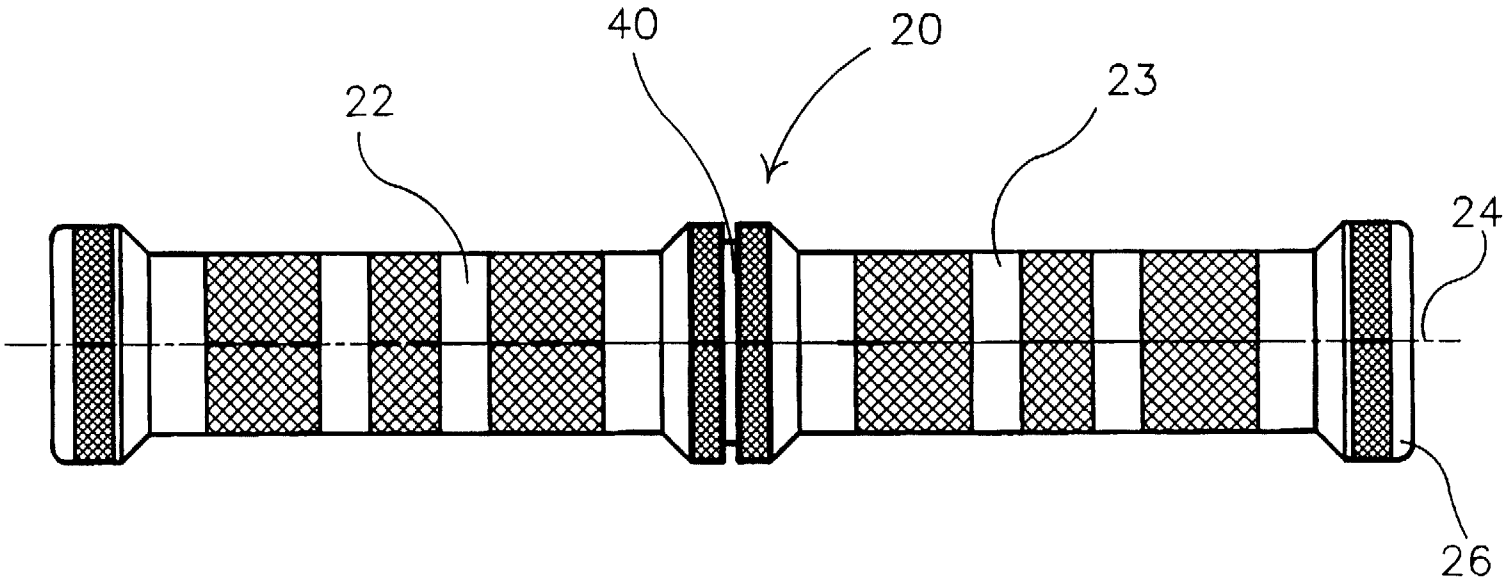
FIG. 1 is a side elevation of a wrist exercise device according to the invention.

As shown in FIG. 1, a wrist exerciser 20 has a first hand grip body 22 and a second hand grip body 23 disposed side-by side on a common axis 24. A user can grip one of hand grip bodies 22, 23 in each hand and turn hand grip body 22 about axis 24 relative to hand grip body 23 against a resistance force to provide the user with exercise of the wrists and forearms. An adjustment knob 26 allows the resistance force to be varied, as described below. Preferably adjustment knob 26 is made of anodized aluminum or another suitable material. Adjustment knob 26 preferably has a knurled or patterned strip around its periphery so that it can be easily grasped and turned by a user. Most preferably, adjustment knob 26 is supported for rotation relative to hand grip body 23 by a thrust bearing 27 (see FIG. 2) between a pair of thrust washers so that adjustment knob 26 can be smoothly rotated.

Hand grip bodies 22 and 23 may be made, for example, from anodized aluminum or from some other durable material. Preferably, hand grip bodies 22 and 23 are generally cylindrical and are knurled or patterned to provide a good gripping surface, at least in their portions which will be gripped by the hands of a user.

Figure 2:
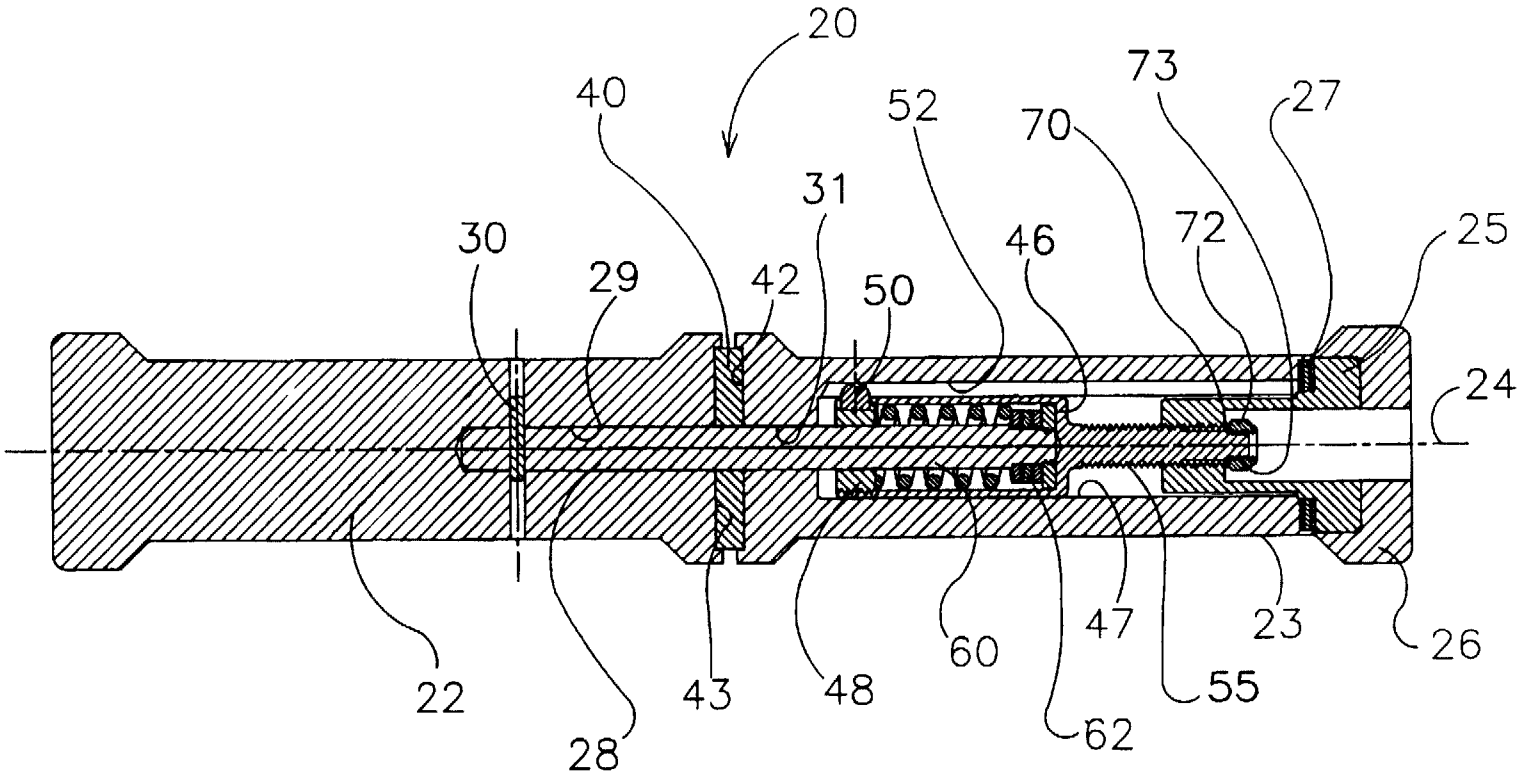
FIG. 2 is a longitudinal sectional view thereof.
Figure 3:
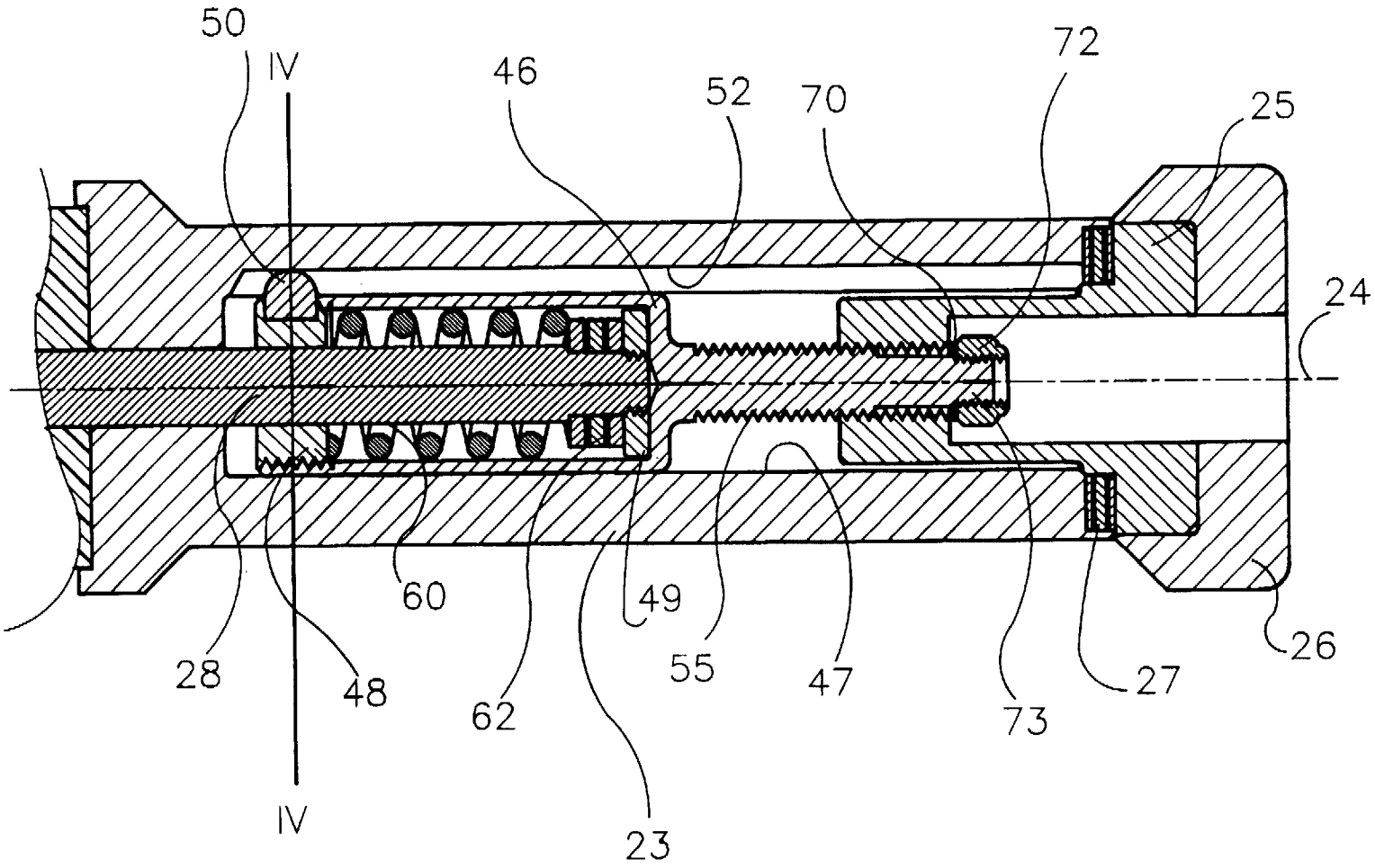
FIG. 3 is an enlarged longitudinal sectional view thereof.
Figure 4:
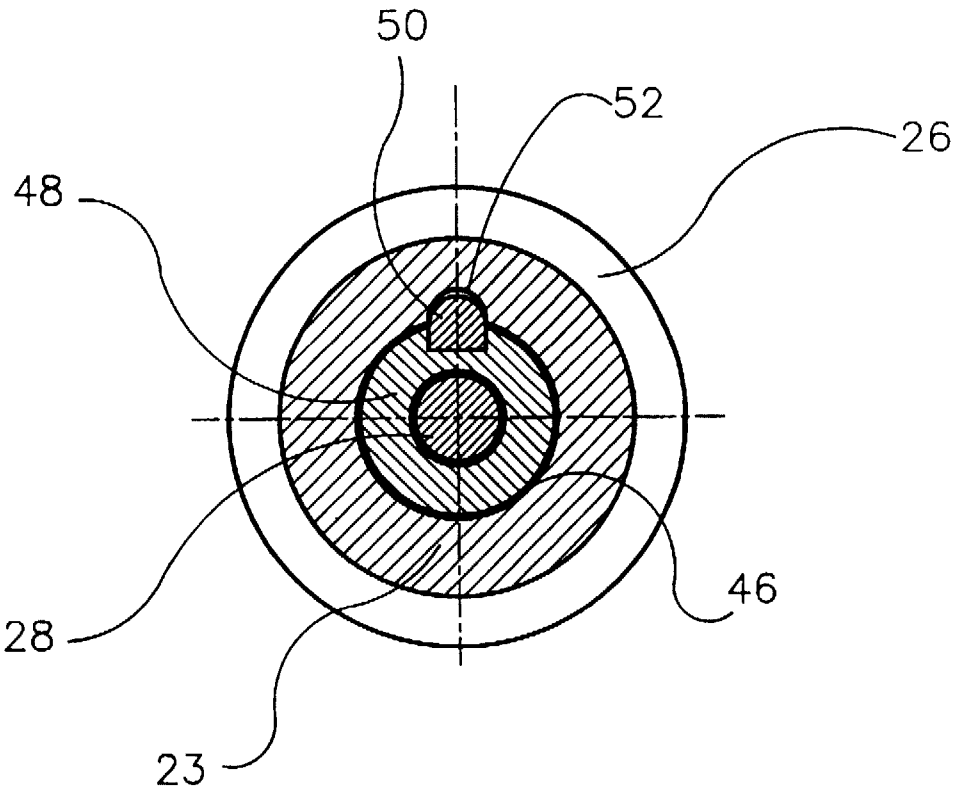
FIG. 4 is a transverse sectional view thereof along the line IV—IV.

As shown in FIG. 2, both of hand grip bodies 22 and 23 are mounted on a rod 28 which extends on axis 24. Rod 28 may be called a "force transmission member" because, as described below, it serves to pull hand grip body 22 toward hand grip body 23. At least one of hand grip bodies 22, 23 is free to rotate relative to rod 28. Preferably rod 28 is affixed in an axial bore 29 in hand grip body 22 by, for example, a pin 30. Rod 28 projects into an axial bore 31 in hand grip body 23 so that hand grip body 23 can be freely rotated about axis 24.

A friction disk 40 is mounted between grip bodies 22 and 23. Friction disk 40 is, for example, made of a self-lubricating plastic such as THORDON™ or another suitable plastic such as a suitable grade of Nylon or Teflon. Most preferably friction disk 40 is located in counterbores in medial ends of each of hand grip bodies 22 and 23. This makes exercise device 20 somewhat more attractive in appearance, helps to prevent dirt from entering the areas between friction disk 40 and bores 42 and helps to prevent dust generated from wear of friction disc 40 and/or friction, surfaces 42 from escaping.

Friction disc 40 could be free to rotate with respect to both of hand grip bodies 22 and 23 but this is not preferred. Preferably friction disk 40 is glued or otherwise affixed to one of hand grip bodies 22 and 23. In the embodiment of FIG. 2, friction disk 40 is affixed to a surface 43 in a counterbore in the medial end of hand grip body 22. Rod 28 passes through a central aperture in friction disk 40. A friction surface 42 on the medial end of grip body 23 presses against a faces of friction disk 40. If hand grip body 23 is made of anodized aluminum then friction surface 42 is preferably not anodized.

A resistance force resisting the rotation of hand grip body 23 relative to hand grip body 22 is provided by friction between friction disk 40 and friction surface 42. A mechanism, which is described below, biases the friction surface 42 on hand grip body 23 toward hand grip body 22, thereby pressing friction disk 40 against friction surface 42. The resistance force can be varied by adjusting the force with which hand grip bodies 22, 23 are biased together.

Hand grip bodies 22 and 23 are biased toward each other by an adjustment mechanism which rotates with hand grip body 23. Because the adjustment mechanism rotates with hand grip body 23, the rotation of hand grip body 23 does not tend to change the setting of the adjustment mechanism. Consequently, the resistance force offered by device 20 can be maintained constant throughout long periods of exercise.

The adjustment mechanism comprises a housing 46, which can be described as an "adjustment member". Housing 46 is slidably mounted within a bore 47 in hand grip body 23. Housing 46 is prevented from rotating in bore 47 by suitable means such as a pin 50 which engages a longitudinal slot 52 in bore 47. Pin 50 is preferably smoothly rounded so that it can glide easily along longitudinal slot 52.

A distal end of housing 46 is connected to adjustment knob 26 by a threaded rod 55. Threaded rod 55 is attached to housing 46 and threadedly engages adjustment knob 26. The longitudinal position of housing 46 in bore 47 can be adjusted by turning adjustment knob 26. Preferably the threads on threaded rod 55 are fine enough to provide fine adjustment of the resistance forces developed by device 20. For example, threaded rod 55 may be a ⅜ inch diameter rod threaded with a ⅜-24UNF thread. Preferably adjustment knob 26 comprises a threaded insert 25 of a durable material, such as stainless steel or a suitable grade of mild steel, to receive threaded rod 55.

A spring 60, which is preferably a coil spring, is located on rod 28 inside housing 46. Spring 60 should fit snugly inside housing 46. The medial end of housing 46 comprises a plug or "spring retainer" 48 which retains the compression spring 60 inside housing 46. Plug 48 may be threaded and screwed into the outer shell of housing 46. Preferably plug 48 is affixed in housing 46 so that it cannot be unscrewed. For example, pin 50 preferably extends into plug 48 and serves to hold plug 48 in place. Rod 28 extends into a medial end of housing 46 through an aperture in plug 48. The distal end of compression spring 60 bears against a thrust bearing 62 mounted to the end of rod 28 by a spring retainer 49 which is attached to rod 28.

It can be appreciated that when adjustment knob 26 is rotated so as to draw housing 46 away from hand grip body 22 compression spring 60 is compressed between plug 48 and thrust bearing 62. This increases the force which biases hand grip bodies 22 and 23 together. The increase in force increases the frictional forces between friction surface 42 on hand grip body 23 and friction disk 40. This, in turn, increases the resistance offered to the relative rotation of hand grip bodies 22 and 23. The force biasing hand grip bodies 22 and 23 together also helps to hold hand grip body 23 aligned with axis 24 by pressing friction surface 42 flat against the surface of friction disk 40.

The spring constant and length of spring 60 are chosen so that the maximum resistance to the relative rotation of hand grip bodies 22, 23 can be set in a desired range. For example, spring 60 might be chosen so that the torque required to rotate hand grip body 23 relative to hand grip body 22 can be smoothly adjusted in the range of about 0 to about 165 or 200 foot pounds by rotating adjustment knob 26.

When hand grip bodies 22 and 23 are rotated relative to one another about axis 24, spring 60, housing 46 and adjustment knob 26 all rotate together with hand grip body 23. No forces tend to turn adjustment knob 26. Thrust bearing 62 provides a relatively friction free interface between spring 60 and the end of rod 28. Preferably, a thrust washer is provided on either side of the thrust bearing 62 so that the spring 60 bears on a hardened surface which is resistant to wearing. A thrust bearing could be located on plug 48 instead of or in addition to the thrust bearing 62 on the end of rod 28. Thrust bearing 62 should be a roller bearing or a ball bearing. While it is not preferred, some of the advantages of the invention could be achieved by using a suitable set of of bushings in place of thrust bearing 62.

Preferably, there is a stop member on the end of threaded rod 55 which prevents knob 26 from being completely removed from threaded rod 55. The stop member may, for example, comprise a spring washer 70 held in place against a shoulder by a self locking nut 72 on a smaller diameter threaded portion 73 projecting axially from the distal end of threaded rod 55.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A exercise device comprising:

a. a first hand grip body;

b. a second hand grip body mounted coaxially to the first hand grip body for rotation relative to the first hand grip body about an axis;

c. biasing means for biasing the first hand grip body toward the second hand grip body, the biasing means comprising:

(i) an adjustment member slidably but non-rotationally mounted in a bore of the second hand grip body, (ii) adjustment means for adjusting the position of the adjustment member along the bore, and, (iii) a compression spring extending between the adjustment member and a force transmission member extending from the first hand grip body.

2. The device of claim 1 wherein the force transmission member comprises a rod extending into the bore in the second hand grip body, the adjustment member comprises a housing extending around an end of the rod and the spring is located in the housing between a first spring retainer on one end of the housing and second spring retainer on the end of the rod.

3. The device of claim 2 wherein at least one end of the spring bears against a thrust bearing.

4. The device of claim 3 wherein the thrust bearing is mounted at an end of the rod adjacent the first spring retainer.

5. The device of claim 3 wherein the thrust bearing is mounted to the housing adjacent the second spring retainer.

6. The device of claim 3 wherein the adjustment means comprises a threaded rod attached to the adjustment member and an adjustment knob on the second hand grip body threadedly receiving a distal end of the threaded rod.

7. The device of claim 6 wherein the adjustment member is prevented from rotating in the bore by a pin engaged in a longitudinal groove in the bore.

8. The device of claim 1 comprising a friction disk disposed between the first and second hand grip bodies and compressed between end surfaces of the first and second hand grip bodies.

9. The device of claim 8 wherein the friction disc is affixed to one of the first and second hand grip bodies.

10. The device of claim 9 wherein the friction disk comprises a material selected from the group consisting of THORDON, Nylon and teflon.

11. The device of claim 9 wherein the friction disk comprises a generally planar face in frictional contact with a generally planar friction surface on one of the first and second hand grip bodies.

12. The device of claim 11 wherein the force transmission member comprises a rod extending into the bore in the second hand grip body, the adjustment member comprises a housing extending around an end of the rod and the spring is located in the housing between a first spring retainer on one end of the housing and second spring retainer on the end of the rod.

13. The device of claim 12 wherein at least one end of the spring bears against a thrust bearing.

14. The device of claim 13 wherein the adjustment means comprises a threaded rod attached to the adjustment member and an adjustment knob on the second hand grip body threadedly receiving a distal end of the threaded rod.

15. The device of claim 14 wherein the adjustment member is prevented from rotating in the bore by a pin engaged in a longitudinal groove in the bore.

16. The device of claim 15 wherein the friction disk is received in a counter bore in an end of the first hand grip body.

17. The device of claim 16 wherein the friction disk is received in a counterbore in the end of the second hand grip body.

18. The device of claim 14 comprising a thrust bearing between the adjustment knob and the second hand grip body.

19. The device of claim 18 wherein the adjustment member comprises a cylindrical housing having an inner diameter and the spring comprises a coil spring having an external diameter substantially equal to the inner diameter of the housing.

20. The device of claim 19 wherein the first spring retainer comprises a plug threadedly engaged in the housing and the rod extends through an aperture in the plug and through the spring.

* * * * *